US006735814B2

(12) United States Patent
Franklin et al.

(10) Patent No.: US 6,735,814 B2
(45) Date of Patent: May 18, 2004

(54) APPARATUS FOR CLEANING HARD-TO-REACH AREAS

(75) Inventors: David W. Franklin, Dallas, TX (US); Daniel J. Brantley, Dallas, TX (US)

(73) Assignee: Mister Services, Inc., Dallas, TX (US)

( * ) Notice: Subject to any disclaimer, the term of this patent is extended or adjusted under 35 U.S.C. 154(b) by 0 days.

(21) Appl. No.: 09/860,374

(22) Filed: May 18, 2001

(65) Prior Publication Data

US 2002/0040513 A1 Apr. 11, 2002

Related U.S. Application Data

(60) Provisional application No. 60/238,164, filed on Oct. 5, 2000.

(51) Int. Cl.[7] ..... A47L 5/14

(52) U.S. Cl. ..... 15/345; 15/340.3

(58) Field of Search ..... 15/340.3, 340.4, 15/345, 348, 349, 346

(56) References Cited

U.S. PATENT DOCUMENTS

| | | | | |
|---|---|---|---|---|
| 1,289,809 A | * | 12/1918 | Kern | 15/345 |
| 2,990,019 A | * | 6/1961 | Finn | 171/89 |

(List continued on next page.)

FOREIGN PATENT DOCUMENTS

| | | |
|---|---|---|
| EP | 0 273 791 A1 | 7/1988 |
| EP | 0 318 940 A2 | 6/1989 |
| EP | 0 321 592 A1 | 6/1989 |
| EP | 0 347 535 A1 | 12/1989 |
| EP | 0 413 905 A1 | 2/1991 |
| EP | 0 416 214 A1 | 3/1991 |
| EP | 0 426 925 A1 | 5/1991 |
| EP | 0 435 414 A1 | 7/1991 |
| EP | 0 453 177 A1 | 10/1991 |
| EP | 0 476 483 A1 | 3/1992 |
| EP | 0 191 066 B1 | 2/1993 |
| EP | 0 586 977 A1 | 3/1994 |
| EP | 0 632 954 A1 | 1/1995 |
| EP | 0 667 095 A1 | 8/1995 |
| EP | 0 674 930 A1 | 10/1995 |
| EP | 0 686 370 A1 | 12/1995 |
| EP | 0 750 072 A1 | 12/1996 |
| EP | 0 948 928 A1 | 10/1999 |
| JP | 56027820 | 3/1981 |
| JP | 56037415 | 4/1981 |
| JP | 57066861 | 4/1982 |
| JP | 57082698 | 5/1982 |
| JP | 60166795 | 8/1985 |
| JP | 63218201 | 9/1988 |
| JP | 01110894 | 4/1989 |
| JP | 01312111 | 12/1989 |

(List continued on next page.)

OTHER PUBLICATIONS

Nite–Hawk Sweeper Promotional Materials.
Buffalo Turbine Promotional Materials.
Tymco Model 600 HSP Promotional Materials.
Nite–Hawk Sweeper Promotional Materials.
Buffalo Turbine Promotional Materials.
Tymco Model 600 HSP Promotional Materials.

*Primary Examiner*—Theresa T. Snider
(74) *Attorney, Agent, or Firm*—Jenkens & Gilchrist, P.C.

(57) ABSTRACT

A method and apparatus for cleaning generally hard-to-reach or inaccessible areas uses a turbine blower attached to at least one duct for blowing debris located in the hard-to-reach or inaccessible area into an accessible area. The apparatus is most typically mounted on a street-cleaning machine that collects debris as the machine is driven over the debris. The duct can be directionally adjusted from a driver's position of the street-cleaning machine. Air flow volume per unit time can be adjusted from the driver's position. The debris is moved using the apparatus from the inaccessible or hard-to-reach area into an area that permits the street-cleaning machine to be driven over the debris to collect the debris.

30 Claims, 3 Drawing Sheets

OTHER PUBLICATIONS

| | | | | | |
|---|---|---|---|---|---|
| 3,284,831 | A | * | 11/1966 | Larsen | 15/82 |
| 3,449,016 | A | | 6/1969 | Knowles et al. | 302/36 |
| 3,670,359 | A | | 6/1972 | Gutbrod | 15/348 |
| 3,676,886 | A | | 7/1972 | Aiuppa | 15/83 |
| 3,691,579 | A | | 9/1972 | Kasper | 15/83 |
| 3,728,850 | A | | 4/1973 | Flory | 56/12.8 |
| 3,755,851 | A | | 9/1973 | Williams | 15/346 |
| 3,808,632 | A | | 5/1974 | Aagesen | 15/340 |
| 3,824,771 | A | | 7/1974 | Williams | 55/429 |
| 3,877,175 | A | | 4/1975 | Snyder | 51/9 |
| 3,959,846 | A | | 6/1976 | Yasuda | 15/331 |
| 3,977,039 | A | | 8/1976 | Block | 15/346 |
| 3,984,893 | A | | 10/1976 | Ashley | 15/339 |
| 3,999,316 | A | | 12/1976 | Palmer | 37/43 |
| 4,001,908 | A | | 1/1977 | Franklin | 15/83 |
| 4,006,511 | A | | 2/1977 | Larsen | 15/300 |
| 4,007,026 | A | | 2/1977 | Groh | 55/302 |
| 4,023,286 | A | | 5/1977 | Wickware | 37/14 |
| 4,044,422 | A | | 8/1977 | Larsen | 15/340 |
| 4,064,679 | A | | 12/1977 | Spinner | 56/2 |
| 4,099,290 | A | | 7/1978 | Hiszpanski | 15/340 |
| 4,109,341 | A | | 8/1978 | Larsen et al. | 15/340 |
| 4,110,864 | A | | 9/1978 | Gunnarsson | 15/340 |
| 4,118,826 | A | | 10/1978 | Kaeser | 15/328 |
| 4,138,756 | A | | 2/1979 | Krier et al. | 15/83 |
| 4,219,901 | A | | 9/1980 | Burgoon et al. | 15/352 |
| 4,237,576 | A | | 12/1980 | Stakes | 15/344 |
| 4,310,944 | A | | 1/1982 | Kroll et al. | 15/346 |
| 4,328,014 | A | | 5/1982 | Burgoon et al. | 55/300 |
| 4,363,151 | A | | 12/1982 | Knowlton | 15/83 |
| 4,404,706 | A | | 9/1983 | Loyd | 15/344 |
| 4,412,660 | A | | 11/1983 | Morin | 241/101.7 |
| 4,413,371 | A | | 11/1983 | Tuggle et al. | 15/405 |
| 4,457,043 | A | | 7/1984 | Oeberg et al. | 15/340 |
| 4,459,719 | A | | 7/1984 | Notestine | 15/349 |
| 4,461,055 | A | | 7/1984 | Zerrer et al. | 15/344 |
| 4,513,471 | A | | 4/1985 | Rahn | 15/340 |
| 4,554,701 | A | | 11/1985 | Van Raaij | 15/340 |
| D285,848 | S | | 9/1986 | Iida et al. | D32/17 |
| D286,927 | S | | 11/1986 | Aiyama | D32/15 |
| 4,660,248 | A | | 4/1987 | Young | 15/340 |
| 4,741,148 | A | | 5/1988 | Ekas, Sr. et al. | 56/12.9 |
| 4,773,121 | A | | 9/1988 | Young | 15/346 |
| 4,779,407 | A | | 10/1988 | Pattee | 56/295 |
| 4,974,283 | A | | 12/1990 | Holsten et al. | 15/349 |
| 4,979,260 | A | | 12/1990 | Holsten et al. | 15/349 |
| 4,984,329 | A | | 1/1991 | Wade | 15/387 |
| 5,010,620 | A | | 4/1991 | Young | 15/347 |
| 5,072,485 | A | | 12/1991 | Young et al. | 15/346 |
| 5,077,920 | A | | 1/1992 | Farrell | 37/247 |
| 5,090,088 | A | | 2/1992 | Toth | 15/405 |
| 5,107,568 | A | | 4/1992 | Wade | 15/387 |
| 5,109,567 | A | | 5/1992 | Harrison | 15/345 |
| 5,113,548 | A | | 5/1992 | Young et al. | 15/346 |
| 5,125,128 | A | | 6/1992 | Davis | 15/340.4 |
| 5,173,989 | A | | 12/1992 | Young et al. | 15/352 |
| 5,218,737 | A | | 6/1993 | Dansby et al. | 15/347 |
| 5,257,479 | A | | 11/1993 | Swain | 51/429 |
| 5,337,444 | A | | 8/1994 | Young et al. | 15/352 |
| 5,361,441 | A | | 11/1994 | Williamson | 15/84 |
| 5,363,533 | A | | 11/1994 | Young et al. | 15/339 |
| 5,435,118 | A | | 7/1995 | Cobile | 56/13.4 |
| 5,542,148 | A | | 8/1996 | Young | 15/346 |
| 5,560,065 | A | | 10/1996 | Young | 15/82 |
| 5,564,147 | A | * | 10/1996 | Young | 15/340.4 |
| 5,577,575 | A | | 11/1996 | Mielo | 184/6.24 |
| 5,852,847 | A | | 12/1998 | Weiss et al. | 15/346 |
| 5,884,359 | A | | 3/1999 | Libhart | 15/346 |
| 6,041,471 | A | | 3/2000 | Charky et al. | 15/320 |
| 6,052,865 | A | | 4/2000 | Schwarze et al. | 15/385 |
| 6,070,290 | A | * | 6/2000 | Schwarze et al. | 15/346 |
| 6,195,836 | B1 | * | 3/2001 | Vanderlinden | 15/340.3 |
| 6,449,799 | B1 | * | 9/2002 | Keller | 15/322 |

FOREIGN PATENT DOCUMENTS

| | | |
|---|---|---|
| JP | 02020712 | 1/1990 |
| JP | 02074709 | 3/1990 |
| JP | 03066811 | 3/1991 |
| JP | 04163240 | 6/1992 |
| JP | 06313308 | 11/1994 |
| JP | 06316910 | 11/1994 |
| JP | 08158337 | 6/1996 |
| JP | 08172839 | 7/1996 |
| JP | 09217326 | 8/1997 |
| JP | 10201690 | 8/1998 |
| JP | 11319718 | 11/1999 |

* cited by examiner

APPARATUS FOR CLEANING HARD-TO-REACH AREAS

RELATED APPLICATIONS

This patent application claims priority from and incorporates by reference U.S. Provisional Patent Application No. 60/238,164, filed on Oct. 5, 2000 and entitled Method of and Apparatus for Cleaning Hard-To-Reach Areas.

BACKGROUND OF THE INVENTION

1. Technical Field

The present invention generally relates to, but is not limited to, cleaning open areas and, more particularly, to a method of and apparatus for cleaning open and/or outdoor areas that are hard-to-reach or generally considered inaccessible to conventional outdoor cleaning equipment.

2. History of Related Art

Cleaning of outdoor areas, such as street cleaning, has existed for many decades. After paved streets were developed, street cleaners, also often referred to as street sweepers, became a necessity because of a large-scale need to remove waste from horses and other animals deposited in public areas. Use of rotary brooms to remove such material from paved surfaces is one method that has been used for years by modem mechanical street-cleaning machines. As used herein, the term "cleaning" comprises sweeping, vacuuming, and/or blowing. The term "outdoor" comprises all areas that can be cleaned by commercial cleaning machines, including but not limited to streets, parking lots, and garages.

Street-cleaning machines that use moving air have been developed to clean open shopping centers, parking garages, and parking lots that have become ubiquitous in today's modem society. Machines that use moving air often employ either a pure vacuum or a regenerative-air system in which the air is recycled. Some machines employ brushes and/or moving water. In many regenerative-air systems, air flow created by a fan or blower is forced through a narrow channel to an enclosed pick-up head riding on a paved surface. The air and debris on the surface are then picked up by a vacuum created by the fan or blower, the debris is collected, and the air is then used to clean the surface again.

Street-cleaning machines, which are often referred to as street-sweeping machines and are typically automotive vehicles, have at least one inherent drawback in that they can only clean surfaces over which they can travel. Thus, obstructed areas, uneven areas, as well as any other areas that a street-cleaning machine cannot travel over or are otherwise hard-to-reach or are inaccessible to the street-cleaning machine cannot be cleaned with the same efficiency that is possible in more open areas.

Hand brooms and small, portable leaf blowers are sometimes used in conjunction with street-cleaning machines to move debris from inaccessible or hard-to-reach areas into the path of the street-cleaning machine. Typical inaccessible or hard-to-reach areas include sidewalks, islands, corners of buildings, bumper curbs, light poles, and stairwells at shopping centers. Use of hand brooms or leaf blowers generally involves two steps and may require two people. A first person blows or sweeps off the inaccessible or hard-to-reach area as the first person walks down it. A second person, a driver, drives the street-cleaning machine and collects the debris swept or blown out into the path of the street-cleaning machine.

If two persons are not involved in the process of cleaning the inaccessible or hard-to-reach area, the driver must periodically dismount from the street-cleaning machine, walk across the inaccessible or hard-to-reach area, blow or sweep the debris into the machine's path, and then mount the street-cleaning machine and drive over the debris. Both the two-person process and the one-person process described above are less efficient and more costly than if the driver were able to clean the inaccessible or hard-to-reach area without needing to dismount the street-cleaning machine.

Therefore, there is a need for a method and an apparatus for cleaning hard-to-reach or inaccessible areas that permit a single person driving a street-cleaning machine to be able to clean the hard-to-reach or inaccessible areas.

SUMMARY OF THE INVENTION

The present invention is directed to a cleaning apparatus and method that satisfy the needs set forth above. The cleaning apparatus of the present invention comprises a wheeled chassis, a device operable to collect debris traveled over by the chassis attached to the chassis, at least one blower attached to the chassis, at least one duct attached to at least one of the at least one blower, and a device operable to control a volume per unit time of the air flow. The at least one duct in combination directs an industrial-capacity air flow toward an area adjacent to the apparatus. The industrial-capacity air flow preferably can be generated independently of a function of the apparatus of collecting debris being traveled over by the chassis. Generation of the air flow preferably does not diminish a capacity of the apparatus to simultaneously collect debris being traveled over by the chassis. In a preferred embodiment, the air flow is adjustable and at least one of the ducts is directionally adjustable. These adjustments can be made via remote control. An instrument for selectively and rapidly reducing air flow through the at least one duct permits debris moved by the apparatus to not be scattered once it is in a desirable location.

A method having features of the present invention comprises the steps of providing an apparatus capable of collecting debris traveled over by the apparatus, directing an industrial-capacity air flow toward a first area adjacent to the apparatus, moving debris located in the first area using the air flow until the debris is no longer located in the first area, and collecting the debris by traveling over the debris with the apparatus. The step of moving preferably further comprises the step of collecting debris located outside the first area during execution of the moving step. The step of moving preferably comprises driving the machine. The direction of the air flow and the air flow per unit time can preferably be adjusted via remote control from a driver's position of the machine.

BRIEF DESCRIPTION OF THE DRAWINGS

A more complete understanding of the method and apparatus of the present invention may be acquired by reference to the following Detailed Description when taken in conjunction with the accompanying Drawings wherein.

DETAILED DESCRIPTION OF THE DRAWINGS

Figure 1:
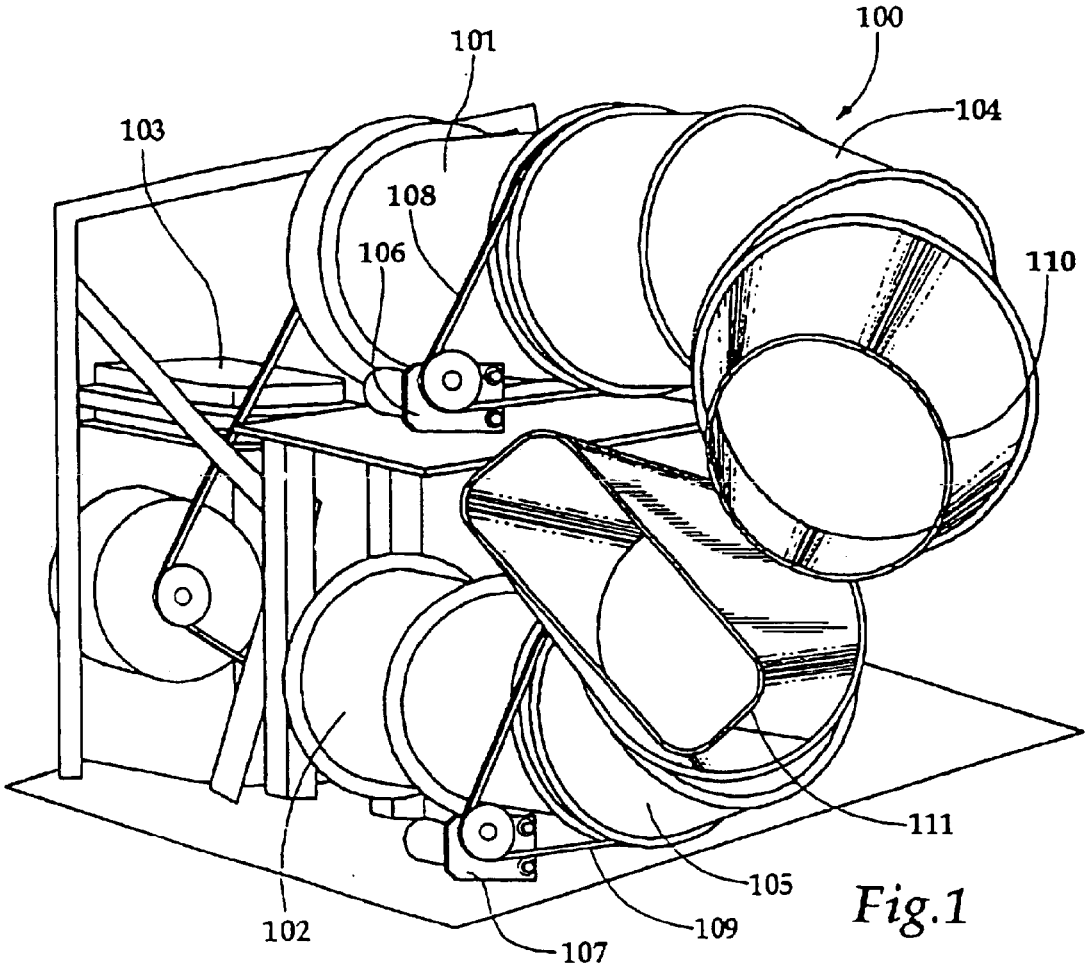
FIG. 1 illustrates a blower-side view of an apparatus in accordance with an embodiment of the present invention.

Referring now to FIG. 1, shown is a blower-side view of an apparatus 100 in accordance with an embodiment of the present invention. The apparatus 100 comprises a pair of blowers 101 and 102, each of which is preferably driven by a diesel engine 103. The blowers 101 and 102 in combination are capable of generating an industrial-capacity air flow, defined herein as 6,500 cubic feet/min or greater. The air flow is preferably turbine-generated, but it can also created by an impeller or any other apparatus that generates an industrial-capacity air flow. It is important that an industrial-capacity air flow be generated, because there must be sufficient air flow volume per unit time to move debris from the hard-to-reach or inaccessible areas into an accessible area. Although a less than industrial-capacity air flow could be used, it has been found that unless at least an industrial-capacity air flow is used, the apparatus and method will not perform satisfactorily in many situations, such as, for example, cleaning around garbage dumpsters, on broad sidewalks, or around large columns. The industrial-capacity air flow is often necessary to move debris from around many obstacles typically found at shopping centers and other industrial or commercial sites. The debris around such a typical obstacle must be moved from behind the obstacle before the apparatus 100 reaches the obstacle and a dead air space behind the obstacle is created as the apparatus 100 passes by the obstacle. Therefore, less than an industrial-capacity air flow is often not sufficient to move debris from behind these typical obstacles.

The engine 103 generates sufficient power to cause the blowers 101 and 102 in combination to produce at least 6,500 cubic feet/minute of air flow. Although the two blowers 101 and 102 are shown, a different number of blowers, such as, for example, one or three, could be employed in accordance with the teachings of the present invention, so long as they in combination are capable of generating an industrial-capacity air flow. In a preferred embodiment, an entire air-flow generation capacity of the blower 101 and the blower 102 can be channeled through ducts 104 and 105, respectively. In addition, although the diesel engine 103 is shown, other types of engines, such as a gasoline engine, could be used. Further, although only the one engine 103 is shown, multiple engines could be used to drive the blowers 101 and 102.

The air flow is nominally directed by the ducts 104 and 105 extending from the blowers 101 and 102, respectively, at an approximately 45 degree angle laterally and also slightly downward relative to a forward path of travel of a street-cleaning machine (not shown) on which the apparatus 100 is most typically mounted. The nominal direction of the air flow by the ducts 104 and 105 need not be as shown, but rather can be in any direction desired to move debris to a given area. Although each of the ducts 104 and 105 as shown has a dedicated blower (i.e., the blowers 101 and 102, respectively), a single blower could be used to feed both of the ducts 104 and 105.

The ducts 104 and 105 are preferably shaped as nozzles so that air-flow pressure is sufficient to move debris as desired. The air flow can be directionally and remotely controlled by a driver of the street-cleaning machine (not shown) from a driver's position (not shown) of the machine by use of devices operable to control the direction of the air flow, which are shown herein as comprising electric motors 106 and 107, respectively. The motors 106 and 107 are interoperably connected to the ducts 104 and 105, respectively, by belts 108 and 109. Movement of the belts 108 and 109 by the electric motors 106 and 107 allows the ducts 103 and 104 to be independently rotated 360 degrees in order to allow the driver to precisely direct the air flow as needed.

The air flow comes through an opening 110 in the duct 104 and from an opening 111 in the duct 105 toward the debris to be moved. Although the electric motors 106 and 107 are shown, the directional control of the air flow could also be achieved by direct linkages, hydraulics, or the like. The driver can control the direction and the volume per unit time of the air flow from the driver's position via various remote control mechanisms (not shown). Remote control is defined herein as control from the driver's position.

Figure 2:
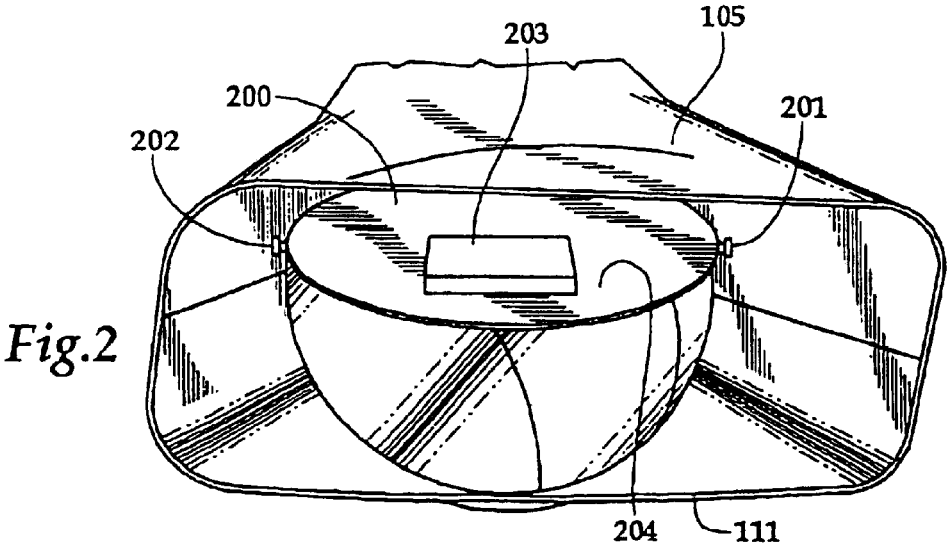
FIG. 2 illustrates a substantially cross-sectional view of a duct with a valve disposed within the duct for rapidly reducing the air flow.

Reference is now made to FIG. 2, wherein is shown a substantially cross-sectional view of the duct 105 with an instrument adapted to selectively and rapidly reduce the air flow, shown as comprising a valve 200 disposed within the duct 105. Although the valve 200 is shown disposed within the duct 105, the valve 200 could also be disposed within, for example, the turbine 102 or at any other point relative to the turbine 102 that permits restriction of the air flow through the duct 105. The duct 104 (not shown) or the turbine 101 can comprise a similar valve to the valve 200.

The valve 200 is preferably rotatably mounted across the opening 111 of the duct 105 by bolts 201 and 202, which are threaded through corresponding holes (not shown) created in opposite sides of the duct 105. The valve 200 permits air flow through the duct 105 to be selectively and rapidly reduced so that, once the debris has been deposited in a desired area, it will not be further scattered by the air flow from the duct 105.

In the embodiment of the valve 200 shown, a weight 203 is attached on a lower portion 204 of the valve 200 in order to provide resistance to the air flow through the duct 105. When the air flow through the duct 105 falls below a pre-determined threshold, the weight 203 causes the valve 200 to shut, which rapidly reduces the air flow through the duct 105. In a preferred embodiment, the driver can cause the air flow through the duct 105 to fall below the predetermined threshold using a throttle interoperably connected to the engine 103, the throttle permitting remote control of the volume per unit time of the air flow through the duct 105. A device operable to control the volume per unit time of air flow could also comprise, for example, a transmission, direct linkage, hydraulics, or the like. Of course, when the air flow is above the predetermined threshold, the valve 200 permits the air flow through the duct 105, the weight being selected so that the valve 200 does not significantly impede the air flow through the duct 105 once the air flow through the duct 105 has exceeded the predetermined threshold.

Although the valve 200 is shown as being responsive to the predetermined threshold, it could also be directly remotely controlled using, for example, electric motors, direct linkages, hydraulics, or the like. Remote control is defined herein as control from the driver's position. Moreover, the valve 200 is not the only possible way to rapidly reduce the air flow; rather, for example, an instrument responsive to an air-flow sensor, a transmission, or the like could be used.

Figure 3:
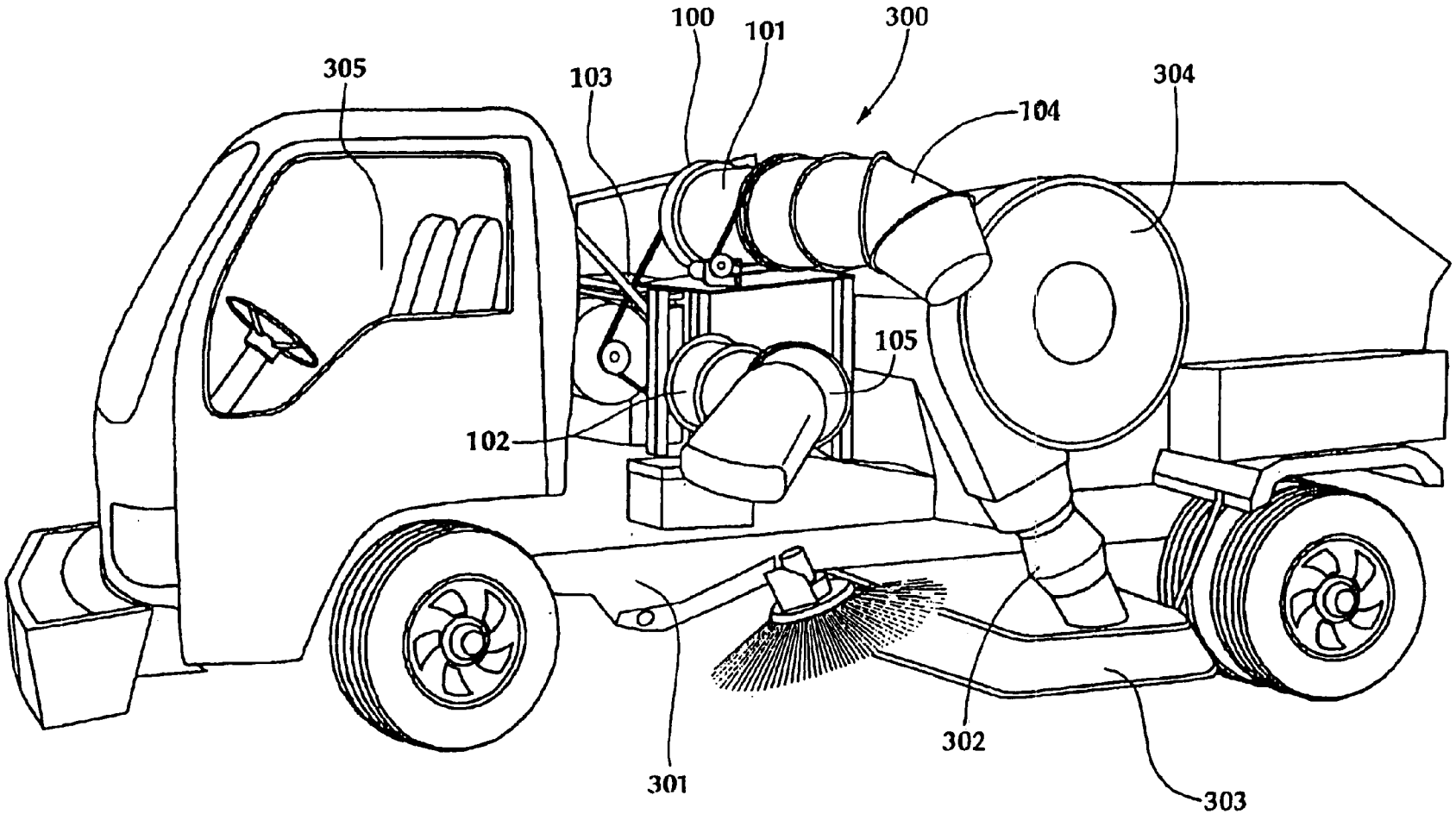
FIG. 3 illustrates a blower-side view of the apparatus mounted on a street-cleaning machine in accordance with the present invention.

Reference is now made to FIG. 3, wherein is shown a blower-side view of the apparatus 100 mounted on a street-cleaning machine in accordance with the present invention. A street-cleaning machine 300 can be, for example, a regenerative-air machine that collects debris over which the machine 300 travels. The machine 300 most typically includes a wheeled chassis 301 and a device 302 operable to collect debris traveled over by the chassis 301. Although the machine 300 as shown is automotive, this need not be so.

The device 302 shown comprises a recirculating air pick-up head 303. The device 302 could also comprise, for example, brushes, brooms, vacuums, pressurized water, or the like. Although the machine 300 as shown comprises a separate blower 304 and a separate engine (not shown) for collecting debris traveled over by the chassis 301 from the engine 103 and the blowers 101 and 102, it will be apparent to those skilled in the art that, for example, a single engine and/or power take off (PTO) and/or a single blower could be used to both clean adjacent areas and to collect debris traveled over by the chassis 301.

As the driver drives the street-cleaning machine 300 adjacent to an inaccessible or hard-to-reach area (not shown), the blowers 101 and 102 of the apparatus 100 create an air flow toward the inaccessible or hard-to-reach area in a nominally forward and lateral direction relative to the forward path of travel of the street-cleaning machine 300, which air flow can result in some debris being bounced off of, for example, a building and into the path of the street-cleaning machine 300. The debris that has been blown into the path of the street-cleaning machine 300 can be collected as the street-cleaning machine 300 drives over it.

Other debris is blown forward along the inaccessible or hard-to-reach area and continues to be pushed forward until the end of the inaccessible or hard-to-reach area is reached. Once the debris pushed forward has been blown out into an area that is accessible to the street-cleaning machine 300, the machine 300 travels over the debris blown into the accessible area to collect it. The air flow directed toward the inaccessible area by the apparatus 100 is preferably at least 6,500 cubic feet/min. while the machine 300 is operating to collect debris being traveled over by the chassis 301. The machine 300 preferably is able to simultaneously collect debris being traveled over by the chassis 301 and blow debris located in the hard-to-reach or inaccessible area into the accessible area. Moreover, generation of the air flow directed toward the inaccessible area preferably does not diminish a capacity of the machine 300 to simultaneously collect debris being traveled over by the chassis 301.

The apparatus 100 can preferably direct an air flow of at least 6,500 cubic feet/min toward the inaccessible area while the machine 300 is operating at full capacity in a function of collecting debris being traveled over by the chassis 301. Moreover, the apparatus 100 can preferably be used independently of and without diminishing an ability of the machine 300 to collect debris being traveled over by the chassis 301. In the embodiment shown, the engine 103 provides the power used to generate the air flow used to clean adjacent areas and a second engine (not shown) provides the power to generate a second air flow used to clean areas traveled over by the chassis 301. In another embodiment, a single engine generates both the air flow directed by the ducts 104 and 105 and the second air flow for collecting debris traveled over by the chassis 301.

The driver can rapidly reduce the air flow via remote control of the valve 200 (not shown). Alternatively, the rapid reduction of air flow can be responsive to an air-flow threshold. The rapid reduction in the air flow prevents scattering of the debris after the debris has been deposited in the accessible area. The driver will typically rapidly reduce the air flow once the debris has been deposited in the accessible area.

One of the key elements to successfully cleaning the inaccessible or hard-to-reach area is having sufficient air flow volume combined with controlled directionality of the air flow. The volume of the air flow can be remotely controlled by the driver from a driver's position 305 of the street-cleaning machine 300. Thus, if the driver determines that more or less air flow volume is needed to achieve the driver's objectives, it can be adjusted. The direction of the air flow can similarly be adjusted to precisely direct the air flow toward debris to be moved. For example, the driver might find that the debris is not being adequately picked up or, conversely, that the debris is being blown too hard and could cause damage to property, such as nearby windows or parked cars. This air-flow adjustment can be remotely controlled from the driver's position 305 and can be achieved using a transmission, throttle, or the like. The directionality of the air flow can similarly be adjusted from the driver's position 305 using electric motors, direct linkages, hydraulics, or the like.

Although the apparatus 100 is attached to the street-cleaning machine 300, it does not interrupt normal operation of the street-cleaning machine 300 in its function of collecting debris from areas over which the chassis 301 travels. Rather, the present invention preferably permits simultaneous generation of sufficient air flow to cause debris in the inaccessible or hard-to-reach area to be moved and of sufficient air flow for the machine 300 to collect debris in its path. The present invention allows the street-cleaning machine 300 to clean not only its path but also to simultaneously clean areas adjacent to its path, regardless of whether those areas are accessible to the machine 300.

Figure 4:
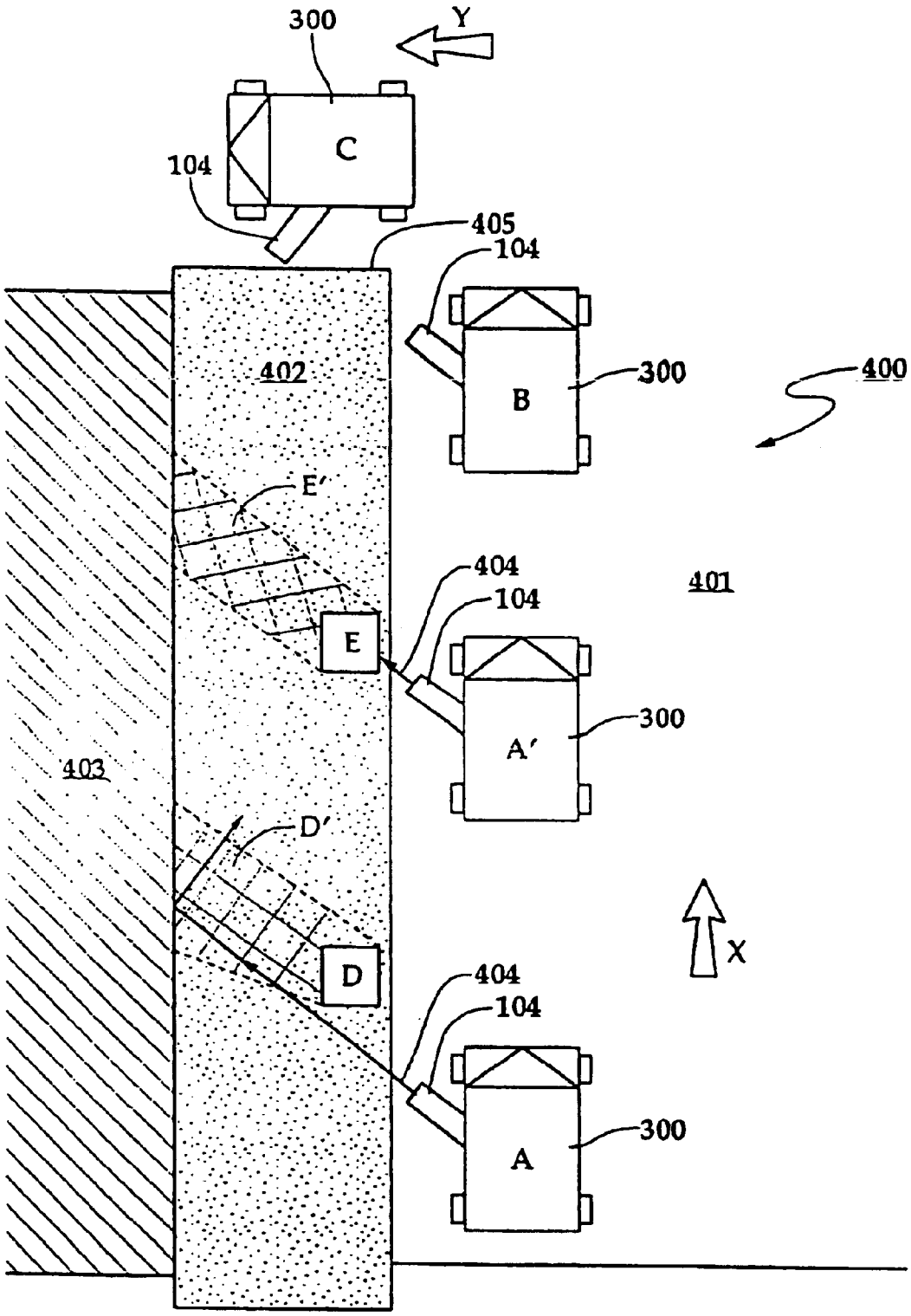
FIG. 4 illustrates a plan view of a typical use of the apparatus mounted on the street-cleaning machine in accordance with the present invention.

Reference is now made to FIG. 4, wherein is shown a plan view of a typical use of the apparatus 100 mounted on the street-cleaning machine 300 in accordance with the present invention. A shopping center 400 that includes a parking lot 401, a sidewalk 402, and a building 403 is shown. The street-cleaning machine 300, including the apparatus 100 (components of which other than the duct 104 not being explicitly shown) is shown at positions A, A', B, and C. Also shown are columns D and E on the sidewalk 402. The columns D and E have associated dead-air space areas D' and E', respectively, the dead-air space areas D' and E' being created when the machine 300 is directing an air flow in a direction 404 directly toward the columns D and E, respectively.

The street-cleaning machine 300 begins to clean the sidewalk 402 at the position A, at which position air is blown from the duct 104 in a direction, generally shown by the arrow 404, onto the sidewalk 402 toward the building 403. The air flow in the direction of the arrow 404 while the machine 300 is at the position A moves debris located in the area D' along the sidewalk 402 in a general direction X. As used herein, the term "cleaning" comprises sweeping, vacuuming, and blowing.

As indicated by the arrow 404 while the machine 300 is located at the position A, some of the debris on the sidewalk 402 will most typically be bounced off the building 403 and forward generally in the direction X along the sidewalk 402. Although the machine 300 operates well when it is generating an industrial-capacity air flow, it has been found that in some environments, such as, for example, those in which more debris needs to be bounced off the building 403, an air flow of at least 9,000 cubic feet/min. is preferred.

In addition, some of the debris on the sidewalk 402 might be moved off the sidewalk 402 and onto the parking lot 401 into a path of the street-cleaning machine 300 between the position A and the position B. Although the duct 105 is not shown, in a preferred embodiment, the duct 105 would also be blowing air generally in the direction of the arrow 404 to move the debris as desired by the driver of the street-cleaning machine 300. As the machine 300 moves from the position A to the position A', the air flow in the direction of the arrow 404 moves debris from the area E' so that when the machine reaches the position A', the debris formerly located in the area E' will have already been moved further in the direction X than the area E'.

As the debris is moved generally in the direction X, the driver of the street-cleaning machine 300 drives the machine 300 in the direction X from the position A to the position A' to the position B and continues to move the debris generally in the direction X along the sidewalk 402 and out into the path of the street-cleaning machine 300. As the machine 300 moves from the position A to the position A' to the position B, the machine 300 simultaneously cleans the sidewalk 402 and collects debris located in its path.

Upon reaching the position B, the air flow from the duct 104 is rapidly reduced, provided that the debris has been deposited in an accessible area of the parking lot 401, an accessible area being an area of the parking lot 401 that can be driven over by the machine 300. After the debris has been deposited in an accessible area of the parking lot 401, the driver of the street-cleaning machine 300 drives over the accessible area, shown herein as the position C. The accessible area of the parking lot 401 is accessed by the street-cleaning machine 300 by the driver executing an approximately 90° left turn at an end 405 of the sidewalk 402 and driving in a direction Y along the end 405 of the sidewalk 402.

Thus, it can be seen from FIG. 4 that the present invention can be used to move debris from an inaccessible or hard-to-reach area, such as a sidewalk or island, into an accessible area, such as an open area of a parking lot, so that the debris can be driven over by a street-cleaning machine and collected. Only one person is needed to perform the removal of the debris.

Although preferred embodiments of the method and apparatus of the present invention have been illustrated in the accompanying Figures and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A cleaning apparatus comprising:

a wheeled chassis;

a device operable to collect debris located on a surface traveled over by the chassis attached to the chassis;

at least one blower attached to the chassis, at least one blower being capable of generating an air flow of at least 6,500 cubic feet per minute; and duct attached to at least one of the blower, the at least one duct adapted to direct the air flow toward an area adjacent to the chassis, wherein the air flow can be generated independently of the device operable to collect debris, and wherein a volume per unit time of the air flow is adjustable.

2. The apparatus of claim 1 wherein at least one duct is directionally adjustable relative the chassis.

3. The apparatus of claim 1 further comprising a device adapted to remotely control a volume per unit time of the air flow and a direction of at least one duct.

4. The apparatus of claim 1 wherein the at least one duct comprises a valve for selectively reducing an air flow volume per unit time of the at least one duct.

5. The apparatus of claim 1 wherein the apparatus is adapted to direct the air flow while the apparatus is operating to collect debris being traveled over by the chassis.

6. The apparatus of claim 1 wherein the apparatus is adapted to direct the air flow while the apparatus is operating at full capacity in a function of collecting debris being traveled over by the chassis.

7. The apparatus of claim 1 further comprising an instrument, attached to the at least one duct, adapted to reduce the air flow.

8. The apparatus of claim 7 wherein the instrument is adapted to selectively reduce air flow through the at least one duct.

9. The apparatus of claim 8 wherein the instrument is adapted to reduce the air flow responsive to an air-flow threshold.

10. The apparatus of claim 8 wherein the instrument adapted to selectively reduce the air flow is responsive to a device operable to remotely control a volume per unit time of air flow.

11. The apparatus of claim 1 wherein the apparatus is operable as a regenerative-air street-cleaning machine.

12. A cleaning apparatus comprising:

a wheeled chassis;

a device operable to collect debris located on a surface traveled over by the chassis attached to the chassis;

at least one blower attached to the chassis at least one blower being capable of generating an air flow of at least 6,500 cubic feet per minute; and duct attached to at least one of the blower, the at least one duct adapted to direct the air flow toward area adjacent to the chassis, wherein the air flow can be generated independently of the device operable to collect debris; and wherein at least one duct is directionally adjustable via a device adapted to remotely control a direction of the air flow.

13. The apparatus of claim 12 wherein:

the at least one blower comprises a first blower and a second blower;

the first blower generates the air flow directed by the at least one duct; and the second blower generates a second air flow for collecting of the debris traveled over by the chassis.

14. The apparatus of claim 12 further comprising a device adapted to remotely control a volume per unit time of the air flow and a direction of at least one duct.

15. The apparatus of claim 12 wherein the at least one duct comprises a valve for selectively reducing an air flow volume per unit time of the at least one duct.

16. The apparatus of claim 12 further comprising an instrument adapted to reduce the air flow.

17. A cleaning apparatus comprising:

a wheeled chassis;

a device operable to collect debris located on a surface traveled over by the chassis attached to the chassis;

at least one blower attached to the chassis at least one blower being capable of generating an air flow of at least 6,500 cubic feet per minute;

duct attached to at least one of the at least one blower, the at least one duct adapted to direct the air flow toward an area adjacent to the chassis, wherein generation of the air flow does not diminish a capacity of the apparatus to simultaneously collect debris being traveled over by the chassis; and an instrument, attached to the chassis, adapted to reduce the air flow.

18. The apparatus of claim 10 wherein at least one duct is directionally adjustable.

19. The apparatus of claim 10 wherein the apparatus is adapted to adjust a volume per unit time of the air flow.

20. The apparatus of claim 17 wherein at least one duct is directionally adjustable via a device adapted to remotely control a direction of the air flow.

21. The apparatus of claim 17 further comprising a device adapted to remotely control a volume per unit time of the air flow and a direction of at least one duct.

22. The apparatus of claim 21 wherein the apparatus is adapted to direct the air flow while the apparatus is operating to collect debris being traveled over by the chassis.

23. The apparatus of claim 21 wherein the apparatus is adapted to direct the air flow while the apparatus is operating at full capacity in a function of collecting debris being traveled over by the chassis.

24. The apparatus of claim 17 wherein the instrument is adapted to selectively reduce the air flow through the at least one duct.

25. The apparatus of claim 24 wherein the selective reduction of the air flow occurs responsive to an air-flow threshold.

26. The apparatus of claim 24 wherein the instrument adapted to selectively reduce the air flow is responsive to a device operable to remotely control a volume per unit time of air flow.

27. The apparatus of claim 17 wherein the air flow can be generated independently of a function of the apparatus of collecting debris being traveled over by the chassis.

28. The apparatus of claim 17 wherein an entire air-flow generation capacity of the at least one blower can be channeled through the at least one duct.

29. The apparatus of claim 17 wherein:

the at least one blower comprises a first blower and a second blower;

the first blower generates the air flow directed by the at least one duct; and the second blower generates a second air flow for collecting of the debris traveled over by the chassis.

30. The apparatus of claim 17 wherein the apparatus is operable as a regenerative-air street-cleaning machine.

* * * * *

UNITED STATES PATENT AND TRADEMARK OFFICE

CERTIFICATE OF CORRECTION

PATENT NO. : 6,735,814 B2
DATED : May 18, 2004
INVENTOR(S) : David W. Franklin et al.

It is certified that error appears in the above-identified patent and that said Letters Patent is hereby corrected as shown below:

Column 1,
Lines 25 and 35, please delete the term “modem” and replace with the term -- modern --.

Column 7,
Line 51, please insert the term -- the -- between the terms “chassis,” and “at”.
Line 54, please delete the phrase “duct attached to at least one of the blower” and replace with the phrase -- at least one duct attached to the at least one blower --.

Column 8,
Line 27, please insert the term -- , the -- between the terms “chassis” and “at”.
Line 30, please delete the phrase “duct attached to at least one of the blower” and replace with the phrase -- at least one duct attached to the at least one blower --.
Line 33, please delete the term “;” and replace with the term -- , --.
Line 56, please insert the term -- , the -- between the terms “chassis” and “at”.
Line 60, please delete the phrase “duct attached to at least one of the blower” and replace with the phrase -- at least one duct attached to the at least one blower --.

Signed and Sealed this

Twenty-first Day of December, 2004

JON W. DUDAS
*Director of the United States Patent and Trademark Office*